United States Patent [19]

Grant

[11] Patent Number: 4,502,294

[45] Date of Patent: Mar. 5, 1985

[54] APPARATUS FOR COOLING LIQUIDS

[75] Inventor: Callum Grant, Glasgow, Scotland

[73] Assignee: Koolflo Limited, Glasgow, Scotland

[21] Appl. No.: 558,719

[22] Filed: Dec. 6, 1983

[51] Int. Cl.[3] ..... B67D 5/62

[52] U.S. Cl. ..... 62/389; 62/119

[58] Field of Search ..... 62/119, 389, 393, 398, 62/399

[56] References Cited

U.S. PATENT DOCUMENTS

| | | | |
|---|---|---|---|
| 2,005,611 | 6/1935 | Carson, Jr. | 62/119 X |
| 3,309,886 | 3/1967 | Welty | 62/119 |
| 3,386,261 | 6/1968 | Cornelius | 62/389 X |
| 4,383,419 | 5/1983 | Bottum | 62/119 X |

*Primary Examiner*—Lloyd L. King

*Attorney, Agent, or Firm*—Bell, Seltzer, Park & Gibson

[57] ABSTRACT

Apparatus 10 for cooling liquid flowing in a pipeline 5, conveniently potable liquid such as beer stored in a bulk container 6 and dispensed at a dispenser 7, comprises a product coil 3 connected in the pipeline 5 and immersed in a liquid body 4 of a volatile liquid such as the refrigerant R12, body 4 being in fluidic communication with a vapor body 9 of the same volatile liquid in which there is immersed a refrigerant coil 2 connected to a refrigeration system 8. Bodies 4 and 9 may be housed in a single container 1 or individually housed in respective containers 11, 13A which are interconnected by a heat pipe 12A.

7 Claims, 2 Drawing Figures

APPARATUS FOR COOLING LIQUIDS

This invention relates to apparatus for cooling liquids which are transported along a pipeline.

Potable liquids such as beer, lager, etc. are normally stored in bulk in a container which tends to assume ambient temperature but are desirably dispensed to customers at notably lower temperatures. For example, whereas ambient temperature is usually around 64° F. beer is preferably dispensed at about 54° F. and lager at about 46° F. in order to suit customer requirements. In one previous proposal to provide the required amount of cooling it has been proposed to cool the bulk storage container by means of a refrigeration plant and to encase the pipelines from that container to the individual dispensing stations (or fonts) with thermal insulation. This proposal however has a number of disadvantages. An alternative proposal which has been implemented has been to provide refrigeration apparatus associated with each pipeline adjacent the pertaining dispensing station. This apparatus comprises a product coil connected in the pipeline and housed within a container holding a body of water. A pump located within the container circulates water over the product coil, the water being cooled by means of a refrigerant coil immersed therein and connected to a conventional refrigeration system. The operation of this known apparatus is such that surrounding the refrigerant coil and within the body of water there is formed a core of ice thereby maintaining the water near freezing point, but liquid to enable circulation by the pump which is controlled thermostatically according to the temperature of the liquid in the product coil.

This known form of refrigeration apparatus suffers from a number of disadvantages in that the pump operates in a relatively hostile environment and is liable to breakdown and the duty cycle of the apparatus is such that initially the cool down period from ambient takes several hours (e.g. 2–4 hours) and thereafter cooling occurs for 15–20 minutes during each hour and under normal dispense condition. In consequence the power consumption of this apparatus is relatively high.

It is an object of the present invention to provide an improved form of apparatus for cooling liquids which are transported along a pipeline.

According to the present invention there is provided apparatus for cooling liquids which are transported along a pipeline, said apparatus comprising means confining a body of volatile liquid and the body of vapour arising therefrom, a refrigeration system incorporating a refrigerant coil, said refrigerant coil being immersed in the vapour body within said confining means, and a product coil immersed in the liquid body within said confining means and connectable at each end of said product coil to a said pipeline.

The means aforesaid may be a single chamber or a pair of chambers interconnected by one or more heat pipes. The volatile liquid is preferably a conventional refrigerant fluid such as R12 but it will be evident that the fluid requires to exist in liquid phase and in vapour phase during the operation conditions of the apparatus.

By virtue of the present invention the duty cycle of the apparatus is relatively short because of the liquid body being in continuous contact with the product coil and the vapour body being in continuous contact with the refrigerant coil. Furthermore the power consumption of the apparatus is relatively low and since the apparatus is free of moving components its reliability is high.

Embodiments of the present invention will now be described by way of example with reference to the accompanying drawing.

Figure 1:
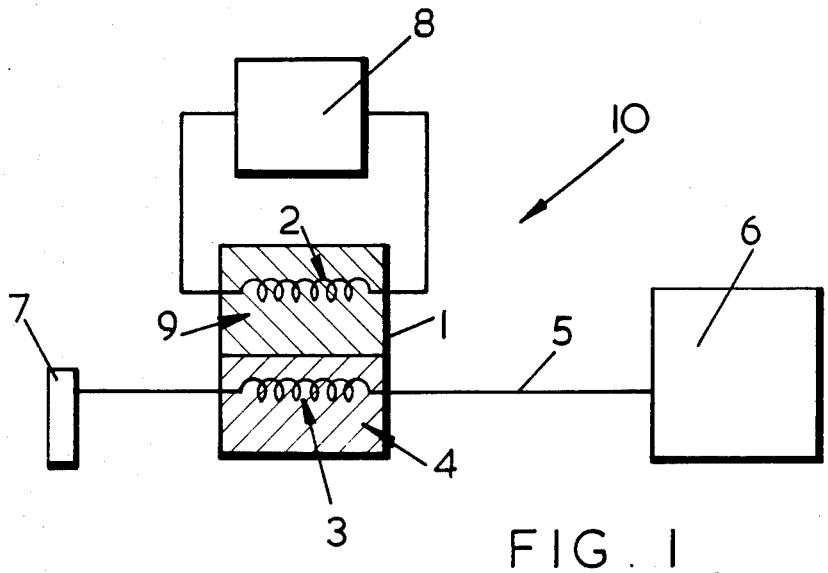
FIG. 1 illustrates a cooling apparatus of the present invention.

In FIG. 1 of the drawings apparatus 10 for cooling beer comprises a pressure-tight vessel 1 containing a pipe coil 3 which is connected into a pipeline 5 so that beer held in a bulk container 6 and dispensed at a dispenser 7 is caused to pass through coil 3. Vessel 1 also contains a pipe coil 2 which is connected to a conventional refrigeration system 8. Vessel 1 further contains a volatile fluid which forms a liquid body 4 and a vapour body 9 and the vessel and its coils are so orientated that product coil 3 lies in and is immersed by the liquid body 4 whereas refrigerant coil 2 lies in and is immersed by the vapour body 9.

In operation of the FIG. 1 embodiment the refrigeration system 8 is actuated by an automatic control which may be either a switch sensitive to the vapour pressure within the vessel 1 or a switch sensitive to the temperature of the beer in the pipeline 5 (preferably on the font side of the vessel 1). Operation of system 8 cools coil 2 causing vapour of the body 9 to condense. The condensed vapour flows under gravity to augment and cool liquid body 4. Simultaneously, heat in the beer flowing along pipeline 5 causes coil 3 to evaporate off or vapourise liquid from the body 4, this vapour augmenting the body 9. In consequence the beer flowing in coil 3 is cooled, and heat is removed from the apparatus by the system 8.

It will be evident that the refrigerating power of system 8 may be varied to suit the particular applications and that the specific nature of the fluid used in the vessel 1 may be selected having regard to its saturation temperature characteristics, the volume of the vessel used, the surface area of the coils 2,3 and the volume of the product coil 3. By way of example we have obtained satisfactory results from a ½ HP refrigerating system operating with vessel 1 of 5 inch diameter and 14 inch length, coil 2 being of 5/16" outside diameter, thin walled and 27' 0" long, coil 3 being of ⅜" outside diameter, thin walled and 12' 0" long (both coils being configured to fit within the vessel 1). The volatile fluid used was R12.

Figure 2:
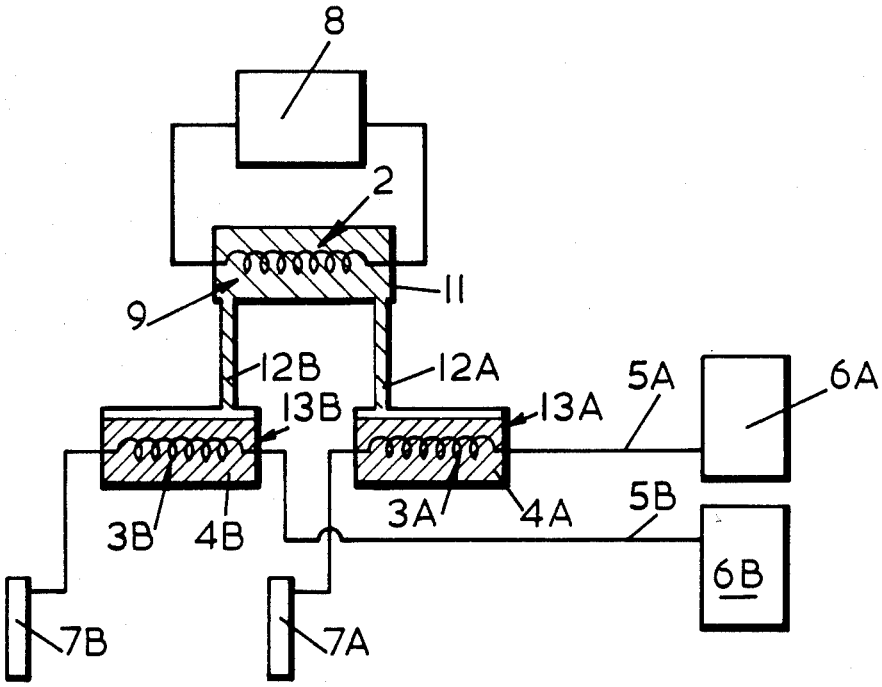
FIG. 2 illustrates an alternative form of the apparatus.

FIG. 2 of the drawings illustrates an alternative form of apparatus according to the present invention. In FIG. 2 system 8 is connected to coil 2 in the same manner as in FIG. 1 but coil 2 is located in a first vessel 11 which is connected by way of heat pipes 12A, 12B to respective second vessels 13A, 13B containing product coils 3A, 3B respectively coupled by pipework 5A, 5B to bulk containers 6A, 6B and dispensers 7A, 7B, with the coils 3A, 3B respectively immersed in liquid bodies 4A, 4B. The operation of the FIG. 2 embodiment is substantially the same as the FIG. 1 embodiment except that simultaneous vapour and liquid transfer takes place along the heat pipes 12A, 12B and depending upon the length and orientation of these pipes they may be provided with an internal wick (known per se) so that gravitational action is eliminated, and vessel 11 located above or below vessels 13A,13B.

It will be evident that the FIG. 2 arrangement is modular in concept and may be extended by coupling up further heat pipes and associated vessels each with a product coil and liquid body. This is most easily achieved by providing a plurality of quick release pipe fittings on the vessel 11 which although enabling access are also pressure tight.

Various advantages arise from the present invention the principal one of which is that the efficiency of the apparatus is high both as regards heat transfer and durability as has already been mentioned. In the modular form depicted in FIG. 2 the individual modules can be factory constructed and charged with the volatile fluid and by means of quick release couplings assembled on site, thereby eliminating processing and charging of the apparatus on site. Because of the virtually instantaneous heat transfer arising from the use of the volatile fluid practically continuous flow of beer can be achieved at the design temperature (i.e. 54° F.) at very low refrigeration cost. For example operating with a duty cycle of about 30 seconds on period during each 40 minutes off, and an initial cool down period of about 1.5 minutes from ambient.

Although the described embodiments relate to the cooling of beer it will be obvious that the present invention is not limited to use in relation to brewery products or to potable liquids.

What is claimed is:

1. Apparatus for cooling liquids which are transported along a pipeline, said apparatus comprising means confining a volatile fluid having liquid and vapour phases co-existing during operation of the apparatus and respectively forming a liquid body and a vapour body, a refrigeration system incorporating a refrigerant coil, said refrigerant coil being immersed in the vapour body within said confining means, and a product coil immersed in the liquid body within said confining means and connectable at each end of said product coil to a said pipeline.

2. Apparatus as claimed in claim 1, wherein said confining means comprises a single chamber containing said liquid body, said vapour body, said refrigerant coil and said product coil.

3. Apparatus as claimed in claim 1, wherein said confining means comprises a pair of chambers interconnected by a heat pipe, said refrigerant coil and said vapour body being confined to one of said chambers and said product coil and said liquid body being confined to the other of said chambers.

4. Apparatus as claimed in claim 3, wherein said heat pipe comprises an internal wick.

5. Apparatus as claimed in claim 3, wherein each chamber and its contents form a factory constructed module which is provided with quick-release couplings.

6. Apparatus as claimed in claim 1, wherein said volatile fluid is a conventional refrigerant fluid.

7. Apparatus as claimed in claim 6, wherein said volatile fluid is R12.

* * * * *